US008746683B2

(12) United States Patent
Yamamoto

(10) Patent No.: US 8,746,683 B2
(45) Date of Patent: Jun. 10, 2014

(54) SHEET FEEDER AND IMAGE FORMING APPARATUS

(75) Inventor: Daisuke Yamamoto, Suntou-gun (JP)

(73) Assignee: Canon Kabushiki Kaisha (JP)

( * ) Notice: Subject to any disclaimer, the term of this patent is extended or adjusted under 35 U.S.C. 154(b) by 685 days.

(21) Appl. No.: 12/473,959

(22) Filed: May 28, 2009

(65) Prior Publication Data

US 2009/0295070 A1 Dec. 3, 2009

(30) Foreign Application Priority Data

May 29, 2008 (JP) ..... 2008-140490

(51) Int. Cl.
*B65H 1/00* (2006.01)

(52) U.S. Cl.
USPC ..... 271/171; 271/147; 271/160; 271/162

(58) Field of Classification Search
USPC ..... 271/171, 162, 160, 147
See application file for complete search history.

(56) References Cited

U.S. PATENT DOCUMENTS 5,815,787 A * 9/1998 Crayton et al. ..... 399/393
6,039,315 A * 3/2000 Lim ..... 271/160
6,182,963 B1 * 2/2001 Yergenson ..... 271/160
7,681,878 B2 * 3/2010 Youn ..... 271/160
2006/0113724 A1 * 6/2006 Ito et al. ..... 271/162

FOREIGN PATENT DOCUMENTS

JP 2007-31064 A 2/2007

* cited by examiner

*Primary Examiner* — Ernesto Suarez
(74) *Attorney, Agent, or Firm* — Rossi, Kimms & McDowell LLP

(57) ABSTRACT

The present invention provides a sheet feeder, which can reliably feed a sheet without requiring the extra operation of a regulating member, and an image forming apparatus.

The sheet feeder comprises an intermediate plate 4 provided in a cassette body 2 so as to rotate in up and down directions around a rotation fulcrum portion 4*a*. The cassette body 2 has a freely movable rear end regulating member 5. The rear end regulating member 5 has a holding portion 5*a* which prevents the rotation fulcrum portion 4*a* of the intermediate plate 4 from being detached from the cassette body 2. In the transportation, the rear end regulating member 5 is set to a position where the holding portion 5*a* prevents the rotation fulcrum portion 4*a* of the intermediate plate 4 from being detached from the cassette body 2 and the intermediate plate 4 can rotate.

12 Claims, 8 Drawing Sheets

SHEET FEEDER AND IMAGE FORMING APPARATUS

BACKGROUND OF THE INVENTION

1. Field of the Invention

The present invention relates to a sheet feeder and an image forming apparatus, and specifically to a sheet feeder into which a sheet cassette is loaded in a detachable manner, and an image forming apparatus including the sheet feeder.

2. Description of the Related Art

Conventionally, for an image forming apparatus such as a printer, a facsimile, and a copier, there has been known one including a sheet feeder in which a sheet cassette is detachably loaded into the apparatus body. In the image formation, the sheet feeder feeds a sheet, stored in the sheet cassette, to an image forming portion by a feed roller.

The sheet cassette is provided with a cassette body storing sheets therein and an intermediate plate which is provided in the cassette body so as to rotate in up and down directions around a rotation fulcrum portion and rotates upward to press the sheet, stored in the cassette body, against the feed roller. The sheet cassette is further provided with a rear end regulating member and a side end regulating member. The rear end regulating member is movably provided in the cassette body in a sheet feeding direction and regulates a rear end position of the sheet stored in the cassette body. The side end regulating member is movably provided in a direction (hereinafter referred to as a width direction) perpendicular to the sheet feeding direction and regulates a side end position of the sheet stored in the cassette body.

For example, when the sheet cassette is transported, or when an image forming apparatus is transported in a state of including the sheet cassette detachably loaded therein, the rotation fulcrum portion of the intermediate plate is detached from the cassette body due to vibrations in the transportation, leading to the breakage of the intermediate plate and the feeding failure. Therefore, conventionally, the intermediate plate is prevented from being detached from the cassette body by virtue of the use of a buffer such as foamed polystyrene and cardboard. However, such a buffer is used only in the transportation of the image forming apparatus, and thus after the image forming apparatus is unpacked, the buffer is discarded. Therefore, in view of environment, the use of buffers has been regarded as a problem.

Thus, for a sheet cassette which can prevent the breakage of the intermediate plate without using the above buffers, Japanese Patent Laid-Open Publication No. 2007-031064 discloses a sheet cassette in which in the transportation, the intermediate plate is fixed by, for example, the rear end regulating member or the side end regulating member provided in the cassette body. The rear end regulating member or the side end regulating member is engaged with the intermediate plate to thereby regulate the rotation of the intermediate plate, whereby the detachment of the intermediate plate from the cassette body and the breakage of the intermediate plate can be prevented.

However, after the sheet cassette having the above constitution is transported, a user should move the rear end regulating member, engaged with the intermediate plate, to a position allowing the intermediate plate to freely rotate, which takes a lot of trouble.

If the rotation of the intermediate plate is prevented by, for example, the side end regulating member, the side end regulating member may be contained in the cassette body without moving the side end regulating member at the position where the side end regulating member is engaged with the intermediate plate to prevent the rotation of the intermediate plate. However, in this case, a user may neglect the movement of the side end regulating member, whereby a sheet cannot be fed from the cassette body.

The present invention has been made in view of the above problems, and an object of the invention is to provide a sheet feeder and an image forming apparatus which can reliably feed a sheet without requiring the extra operation of a regulating member.

SUMMARY OF THE INVENTION

The present invention provides a sheet feeder which feeds a sheet, stored in a sheet cassette, by a sheet feed member. The sheet cassette includes: a cassette body which stores sheets therein; a sheet stacking plate which is rotatably supported by a rotation support portion in the cassette body and rotates to press the stored sheets stacked on the sheet stacking plate against the sheet feed member; a regulating member which is movably provided in the cassette body and regulates a position of the sheets stacked on the sheet stacking plate; and a detachment preventing portion which is provided in the regulating member and prevents the sheet stacking plate from being detached from the cassette body by regulating the rotation support portion in a state that the sheet stacking plate can rotate.

According to the present invention, a regulating member regulating the position of a sheet is set to a position where a sheet stacking plate is prevented from being detached from a cassette body in the transportation and the sheet stacking plate can be rotated, whereby the sheet can be reliably fed without requiring the extra operation of the regulating member.

Further features of the present invention will become apparent from the following description of exemplary embodiments with reference to the attached drawings.

DESCRIPTION OF THE EMBODIMENTS

Hereinafter, exemplary embodiments for carrying out the present invention will be described in detail using the drawings.

Figure 1:
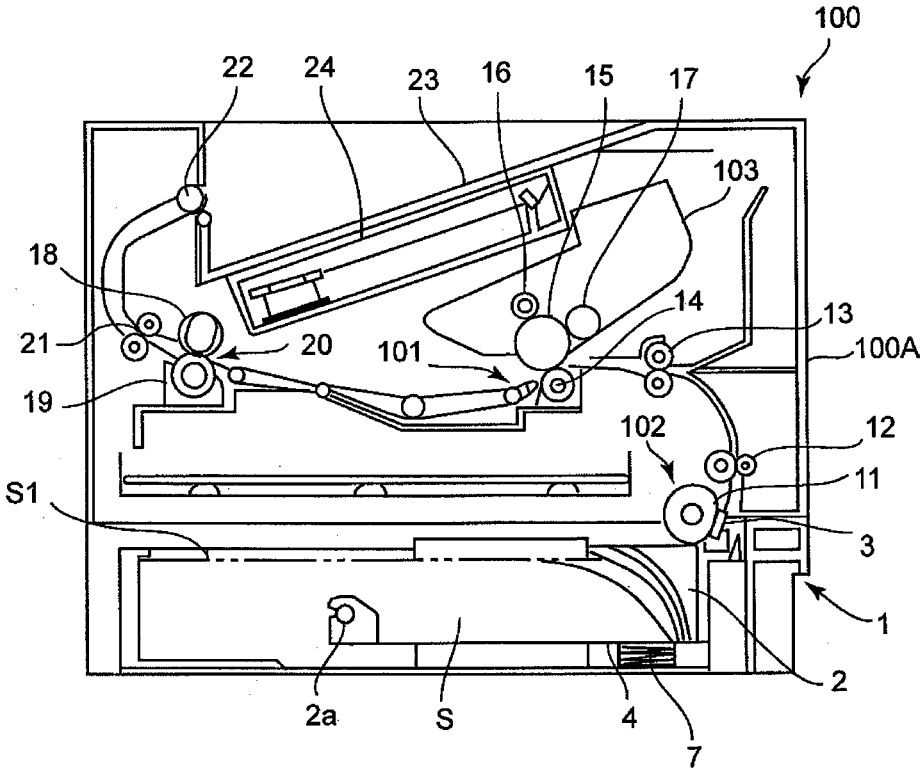
FIG. 1 is a view illustrating a schematic configuration of a laser beam printer which is an example of an image forming apparatus including a sheet feeder according to a first embodiment of the present invention.

FIG. 1 is a view illustrating a schematic configuration of a laser beam printer which is an example of an image forming apparatus including a sheet feeder according to a first embodiment of the present invention.

As illustrated in FIG. 1, a laser beam printer 100 is provided with an image forming unit 101 performing image formation and a sheet feeder 102 separately feeding sheets S one by one to the image forming unit 101. The image forming unit 101 includes a process cartridge 103, which is detachably attachable to a laser beam printer body (hereinafter referred to as a printer body) 100A which is an apparatus body, and a transfer roller 14.

The process cartridge 103 includes a photosensitive drum 15, a charging roller 16, a developing unit 17, and a cleaning unit (not illustrated). The sheet feeder 102 is provided with a sheet cassette 1 which is a sheet storing portion stacking and storing the sheets therein and a feed roller 11 which is a sheet feed member having a substantially half-moon shape cut out in its part of the circumferential surface.

The sheet cassette 1 is provided with a cassette body 2 and an intermediate plate 4, which is a sheet stacking plate provided in the cassette body 2 rotatably (movably) in up and down directions around a rotation fulcrum shaft 2*a* provided in the cassette body 2. When the sheet cassette 1 is loaded in the printer body 10A, the intermediate plate 4 rotates upward to a sheet-feedable position where the sheet S stacked on the intermediate plate 4 is pressed against the feed roller 11 with a predetermined pressure by means of a bias member 7 such as a spring.

In FIG. 1, a separation pad 3 is biased toward the feed roller 11 with a predetermined pressing force of a bias member (not illustrated) and forms a nip with the feed roller 11. The sheet cassette 1 is further provided with a laser scanner unit 24, a fixing unit 20, and a pair of discharge rollers 21 and 22 discharging the sheet S into a discharge tray 23.

Next, an image forming operation performed by the laser beam printer 100 having the above constitution will be described. Before the start of the image forming operation, a plurality of sheets S stacked on the intermediate plate 4 in their ends are pressed up toward the feed roller 11 by a predetermined pressing force attributable to the intermediate plate 4.

When image information is sent from, for example, a personal computer (not illustrated), a control portion (not illustrated) applies image formation processing to the image information and generates a print signal. In response to the print signal, the feed roller 11 controlled so as to rotate in a counterclockwise direction only in the feeding of sheets is rotated to feed the stacked sheets S from the sheet cassette 1 to the image forming unit 101. When the plurality of sheets S are nipped between the feed roller 11 and the separation pad 3, the separation pad 3 causes only the uppermost sheet S1 to be fed into the image forming unit 101.

Meanwhile, on the basis of the above print instruction and the image information, a laser beam is irradiated from the laser scanner unit 24 onto the photosensitive drum 15, whereby a latent image is formed on the surface of the photosensitive drum 15. The latent image is then developed by the developing unit 17, whereby a toner image is formed on the photosensitive drum 15.

The toner image thus formed on the photosensitive drum 15 is thereafter transferred onto the sheet S fed into a nip portion between the photosensitive drum 15 and the transfer roller 14 by means of a conveying roller 12 and a registration roller 13.

The sheet S transferred with the toner image is further fed to the fixing unit 20 to be introduced into a nip portion between a heating unit 18 of the fixing unit 20 and a pressure roller 19 pushed against the heating unit 18. When the sheet S passes through the nip portion between the heating unit 18 and the pressure roller 19, the toner image transferred onto a sheet surface of the sheet S is heated and pressurized to be fixed onto the sheet surface. Thereafter, the sheet having passed through the fixing unit 20 is fed by the discharge roller pair 21, 22, and thus, to be discharged onto the discharge tray 23.

Figure 2:
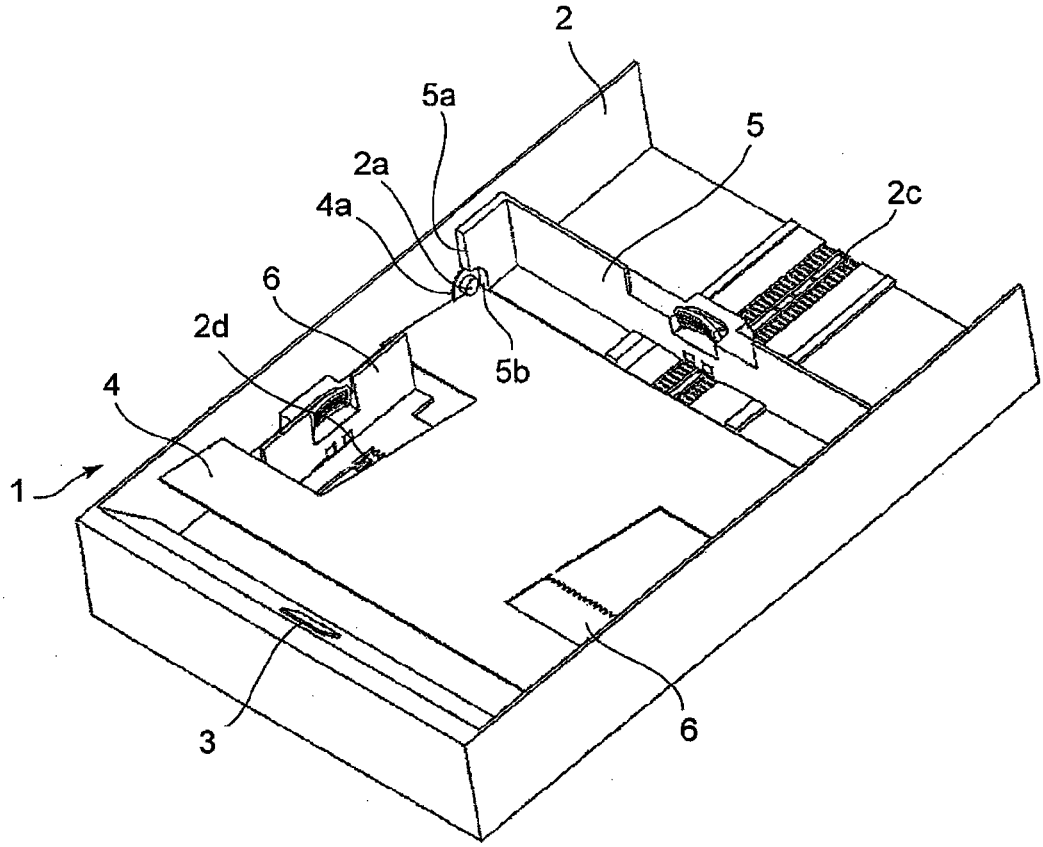
FIG. 2 is a perspective view of a sheet cassette provided in the sheet feeder.

In the present embodiment, the sheet cassette 1, as illustrated in FIG. 2, includes a rear end regulating member 5 regulating the rear end position of the sheet and a side regulating member 6 regulating the position in the width direction of the sheet, in addition to the cassette body 2, the intermediate plate 4, and the bias member (not illustrated) for applying a force to the intermediate plate 4. The rear end regulating member 5 freely moves along the sheet feeding direction in the cassette body 2. The side regulating member 6 is provided opposite to the width direction and freely moves. The rear end regulating member 5 and the side regulating member 6 freely move to a position of regulating the rear end and the side portion of the sheet according to the size of the sheet.

The intermediate plate 4 has a rotation fulcrum portion 4*a* provided engageably with the rotation fulcrum shaft 2*a*, which is a support portion provided in the cassette body 2. The rotation fulcrum portion 4*a* is an engagement portion and constitutes a rotation support portion with the rotation fulcrum shaft 2*a*.

The intermediate plate 4 in its vicinity of the rotation fulcrum portion 4*a* or the rotation fulcrum shaft 2*a* of the cassette body 2 is elastically deformed to be attached to the cassette body 2, and thus the intermediate plate 4 can be rotated in the up and down directions around the rotation fulcrum shaft 2*a* of the cassette body 2. In the feeding of sheets, the intermediate plate 4 is pressed into contact against the feed roller 11 by a predetermined pressing force by means of the bias member, whereby the sheet can be stably fed.

When the sheet cassette 1 is loaded into the printer body 10A, or when the sheet cassette 1 itself is transported, due to the large vibration in the up and down directions, the intermediate plate 4 may be broken, or may be detached from the rotation fulcrum shaft 2*a* of the cassette body 2.

Therefore, in the present embodiment, as illustrated in FIG. 2, the rear end regulating member 5 has at its both ends a holding portion 5*a* which is a detachment preventing portion for preventing the intermediate plate 4 from being detached from the cassette body 2 and provided toward the intermediate plate 4. The holding portion 5*a* has in its lower portion of the end a cut-out 5*b* curved so as to follow the rotation fulcrum portion 4*a* of the intermediate plate 4.

Figure 3A:
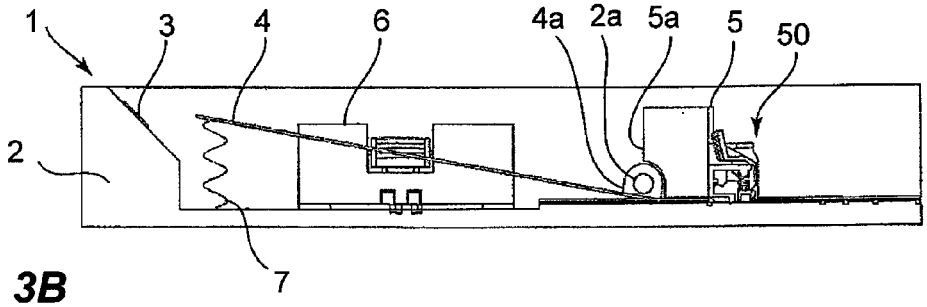
FIGS. 3A, 3B and 3C are views for describing a configuration of a rear end regulating member provided in the sheet cassette.

In the transportation, as illustrated in FIG. 3A, the cut-out 5*b* of the holding portion 5*a* causes the rear end regulating member 5 to be moved to a position where the cut-out 5*b* covers the rotation fulcrum portion 4*a* of the intermediate plate 4 from above. The rear end regulating member 5 is disposed (set) in such a position, whereby the rotation fulcrum portion 4*a* of the intermediate plate 4 can be held by the holding portion 5*a* so as not to move in the up and down directions. Accordingly, the breakage of the intermediate plate 4 and the detachment of the intermediate plate 4 from the rotation fulcrum shaft 2*a* of the cassette body 2 due to vibrations and impacts can be prevented.

Figure 3B:
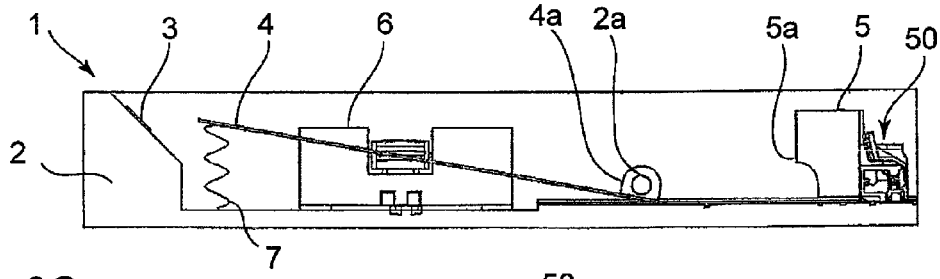

After the transportation of the laser beam printer 100 is finished, the image forming operation by the laser beam printer 100 is started. During such normal use, the rear end regulating member 5 is moved in accordance with, for example, the sheet size, as illustrated in FIG. 3B. The rear end regulating member 5 is moved to a position corresponding to the sheet size, whereby the sheet can be fed. Meanwhile, in accordance with the size of a sheet to be used, the sheet may be stored in the cassette body while the rear end regulating member 5 is set to a position in the transportation illustrated in FIG. 3A. Namely, in the present embodiment, in the transportation, the rear end regulating member 5 is set to a position of regulating the position of a sheet of a predetermined size.

Figure 4:
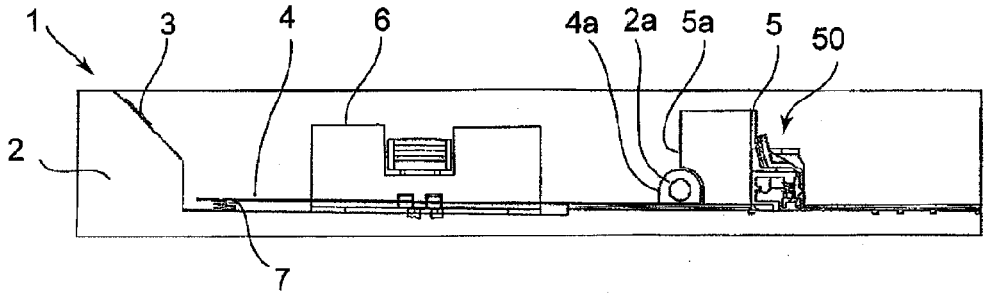
FIG. 4 is a view illustrating a state that sheets are stored in the sheet cassette.

The rear end regulating member 5 is set to the position illustrated in FIG. 3A to be fixed to a set position by a lock unit 50. In such a state, when a sheet (not illustrated) is stored, the intermediate plate 4 rotates downward in such a state that the rotation fulcrum portion 4*a* of the intermediate plate 4 is engaged with the rotation fulcrum shaft 2*a* of the cassette body 2, as illustrated in FIG. 4.

Figure 3C:
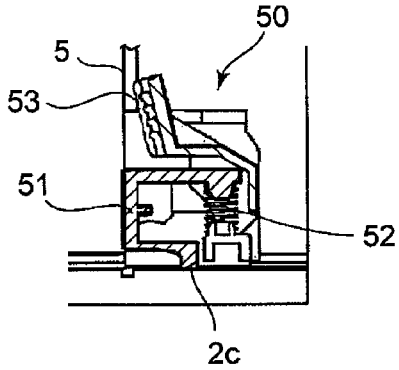

The lock unit 50, as illustrated in FIG. 3C, has a rear end regulating lock member 51 which holds the rear end regulating member 5 so as to prevent the rear end regulating member 5 from moving along the sheet feeding direction, a rear end regulating lock bias member 52 for applying a force to the rear end regulating lock member 51, and a rear end lever 53.

When the rear end regulating member 5 is locked by the lock unit 50 having the above constitution, the rear end regulating lock member 51 is meshed with a rear end lock portion 2*c* of the cassette body 2. When the lock of the rear end regulating member 5 is released, the rear end lever 53 is held to move up the rear end regulating lock member 51, whereby the rear end regulating lock member 51 is detached from the rear end lock portion 2*c*. According to this constitution, the rear end regulating member 5 can move.

The rear end regulating member 5 has such a constitution that when located at the position in the transportation illustrated in FIG. 3A, it is prevented from coming into contact with the intermediate plate 4. Namely, in the present embodiment, in the transportation, the cut-out 5*b* of the holding portion 5*a* covers the rotation fulcrum portion 4*a* of the intermediate plate 4 from above, and, at the same time, the rear end regulating member 5 is set to a position not in contact with the intermediate plate 4.

According to the above constitution, in the transportation, even if vibrations and impacts occur, the rotation fulcrum portion 4*a* of the intermediate plate 4 is held by the rear end regulating member 5, whereby the breakage of the intermediate plate 4 in the transportation and the detachment of the intermediate plate 4 from the rotation fulcrum shaft 2*a* can be prevented. Further, when the rear end regulating member 5 is set to the above transportation position, the rear end regulating member 5 is not in contact with the intermediate plate 4, and therefore, it is unnecessary to perform the operation for sliding the rear end regulating member 5 to a position allowing the intermediate plate 4 to freely rotate, depending on the sheet size. According to this constitution, usability is enhanced, and the feeding failure due to erroneous operation does not occur.

Namely, in the present embodiment, floating of the intermediate plate 4 is not hampered by the rear end regulating member 5, and therefore, it is unnecessary to perform the operation for sliding the rear end regulating member 5 to the position allowing the intermediate plate 4 to freely rotate, whereby the usability is improved.

As described above, in the present embodiment, in the transportation, the holding portion 5*a* prevents the rotation fulcrum portion 4*a* of the intermediate plate 4 from being detached from the rotation fulcrum shaft 2*a* of the cassette body 2, and, at the same time, the rear end regulating member 5 is set to the position allowing the rotation of the intermediate plate 4. According to this constitution, extra operations are not required, resulting in reliable feeding of the sheets.

In the above embodiment, the holding portion 5*a* is provided in the rear end regulating member 5, whereby the intermediate plate 4 is prevented from being fallen from the cassette body 2; however, this invention is not limited thereto. A holding portion for holding the rotation fulcrum portion 4*a* of the intermediate plate 4 may be formed in the side regulating member 6.

Next, a second embodiment of this invention will be described. In the second embodiment, a holding portion for holding the rotation fulcrum portion 4*a* of the intermediate plate 4 is formed in the side regulating member 6.

Figure 5:
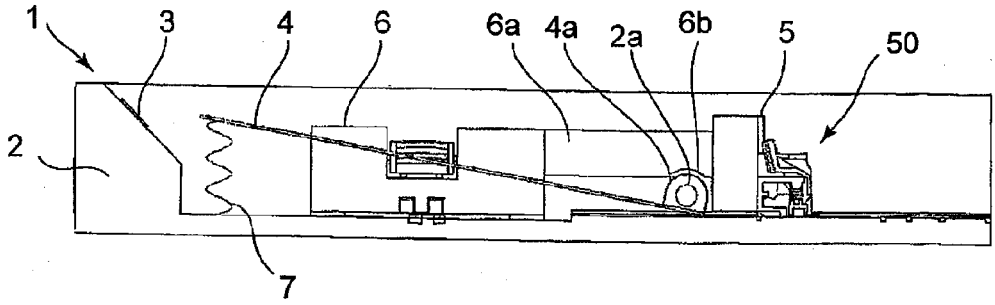
FIG. 5 is a cross-sectional view for describing a configuration of a sheet cassette provided in a sheet feeder according to a second embodiment of the present invention.

FIG. 5 is a cross-sectional view for describing a configuration of a sheet cassette provided in a sheet feeder according to the second embodiment of the present invention. In FIG. 5, the same reference numerals as those of FIG. 1 represent the same or equivalent portions.

In FIG. 5, holding portions 6*a* are respectively provided in the two opposed side regulating members 6 and extend toward the rotation fulcrum portion 4*a* of the intermediate plate 4. The holding portion 6*a* has in its lower portion of the end a recess 6*b* curved so as to follow the rotation fulcrum portion 4*a* of the intermediate plate 4.

Figure 6A:
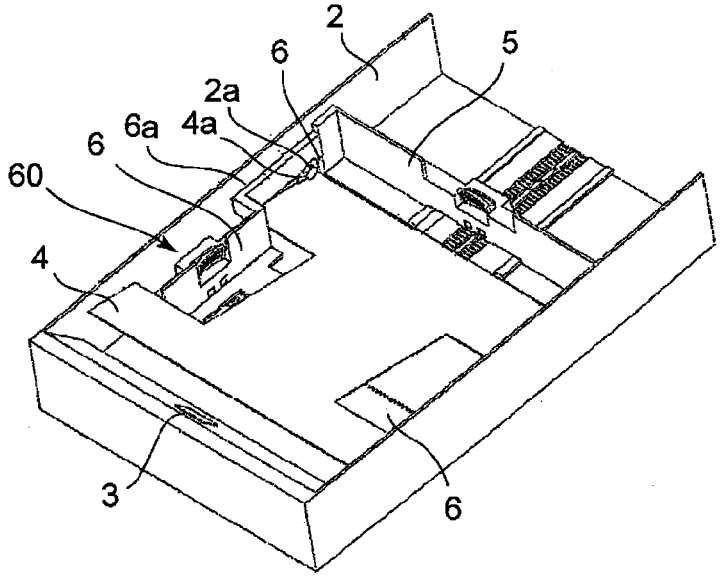
FIGS. 6A, 6B and 6C are views for describing a configuration of a side end regulating member provided in the sheet cassette.

In the transportation, as illustrated in FIG. 6A, the side regulating member 6 moves to the center side in the width direction so that the recess 6*b* of the holding portion 6*a* covers the rotation fulcrum portion 4*a* of the intermediate plate 4 from above. The side regulating member 6 is installed in such a position, whereby the rotation fulcrum portion 4*a* of the intermediate plate 4 can be held by the holding portion 6*a*. Accordingly, the breakage of the intermediate plate 4 and the detachment of the intermediate plate 4 from the rotation fulcrum shaft 2*a* of the cassette body 2 due to vibrations and impacts can be prevented.

Figure 6B:
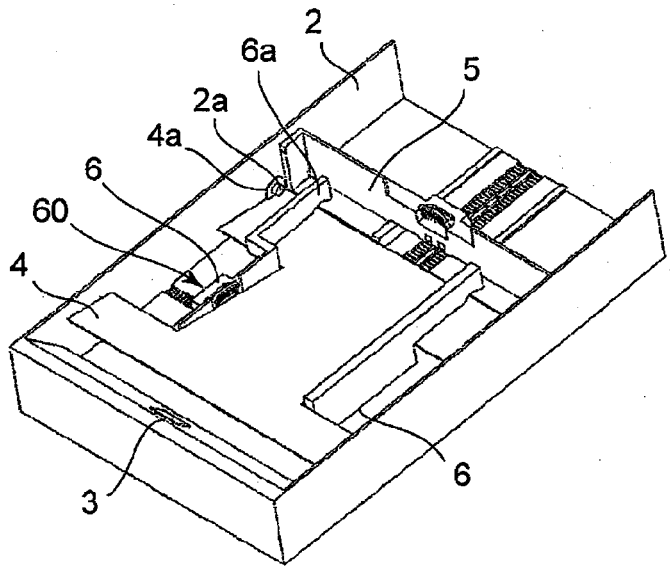

After the transportation of the laser beam printer 100 is finished, the image forming operation by the laser beam printer 100 is started. During such normal use, the side regulating member 6 is moved in accordance with, for example, the sheet size, as illustrated in FIG. 6B. The side regulating member 6 is moved to a position corresponding to the sheet size after the transportation of the laser beam printer 100, whereby it becomes possible to feed the sheet. Meanwhile, in accordance with the size of a sheet to be used, the sheet may be set while the side regulating member 6 is located at a position in the transportation illustrated in FIG. 6A.

When the side regulating member 6 is set to the positions illustrated in FIGS. 6A and 6B, it is fixed to the set positions by a lock unit 60. In such a state, when a sheet (not illustrated) is set, the intermediate plate 4 rotates downward in such a state that the rotation fulcrum portion 4*a* of the intermediate plate 4 is engaged with the rotation fulcrum shaft 2*a* of the cassette body 2.

Figure 6C:
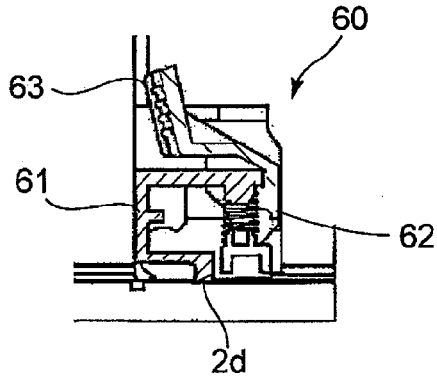

The lock unit 60, as illustrated in FIG. 6C, has a side regulating lock member 61 which holds the side regulating member 6 so as to prevent the side regulating member 6 from moving in the width direction, a side regulating lock bias member 62 for applying a force to the side regulating lock member 61, and a side lever 63.

When the side regulating member 6 is locked by the lock unit 60 having the above constitution, the side regulating lock member 61 is meshed with a side lock portion 2*d* of the cassette body 2. When the lock of the side regulating member 6 is released, the side lever 63 is held to move up the side regulating lock member 61, whereby the side regulating lock member 61 is detached from the side lock portion 2*d*. According to this constitution, the side regulating member 6 can move freely.

The side regulating member 6 has such a constitution that when located at the position in the transportation illustrated in FIG. 6A, it is prevented from coming into contact with the intermediate plate 4. Namely, in the present embodiment, in the transportation, the recess 6*b* of the holding portion 6*a* covers the rotation fulcrum portion 4*a* of the intermediate plate 4, and, at the same time, the side regulating member 6 is set to a position not in contact with the intermediate plate 4.

According to the above constitution, in the transportation, even if vibrations and impacts occur, the rotation fulcrum portion 4*a* of the intermediate plate 4 is held by the side regulating member 6, whereby the breakage of the intermediate plate 4 in the transportation and the detachment of the intermediate plate 4 from the rotation fulcrum shaft 2*a* can be prevented. Further, when the side regulating member 6 is set at the above transportation position, the side regulating member 6 is not in contact with the intermediate plate 4, and therefore, it is unnecessary to perform the operation for sliding the side regulating member 6 to a position allowing the intermediate plate 4 to freely rotate, depending on the sheet size. According to this constitution, the usability is enhanced, and the feeding failure due to erroneous operation does not occur.

Namely, in the present embodiment, floating of the intermediate plate 4 is not hampered by the side regulating member 6, and therefore, it is unnecessary to perform the operation for sliding the side regulating member 6 to the position allowing the intermediate plate 4 to freely rotate, whereby the usability is improved.

In the first and second embodiments described above, the holding portions 5*a* and 6*a* prevent the rotation fulcrum portion 4*a* of the intermediate plate 4 from being detached from the rotation fulcrum shaft 2*a* of the cassette body 2; however, this invention is not limited thereto. For example, when the rotation fulcrum shaft 2*a* of the cassette body 2 is prevented from being detached from the rotation fulcrum portion 4*a* of the intermediate plate 4 by virtue of the use of these holding portions, a similar effect can be obtained.

Next, a third embodiment of the present invention will be described.

Figure 7:
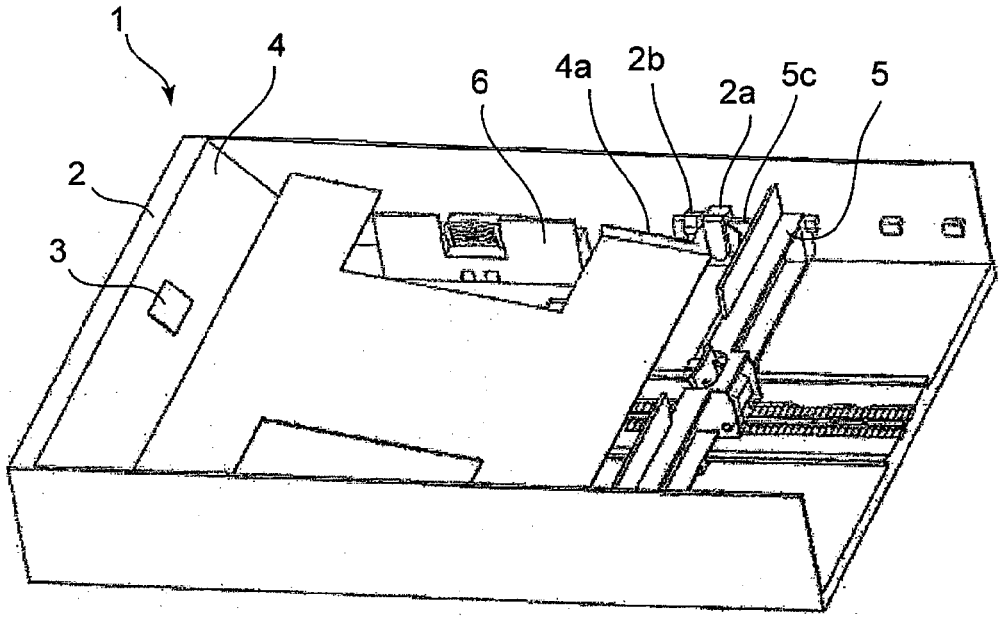
FIG. 7 is a perspective view for describing a configuration of a sheet cassette provided in a sheet feeder according to a third embodiment of the present invention.

FIG. 7 is a perspective view for describing a configuration of a sheet cassette provided in a sheet feeder according to the present embodiment. In FIG. 7, the same reference numerals as those of FIG. 1 represent the same or equivalent portions.

In FIG. 7, an intermediate plate holding portion 2*b* holds the intermediate plate 4 held by the rotation fulcrum shaft 2*a*. When the intermediate plate 4 is attached to the cassette body 2, the rotation fulcrum shaft 2*a* and the intermediate plate holding portion 2*b* are elastically deformed, whereby the intermediate plate 4 is attached between the rotation fulcrum shaft 2*a* and the intermediate plate holding portion 2*b* while engaging the rotation fulcrum portion 4*a* with the rotation fulcrum shaft 2*a*.

Figure 8A:
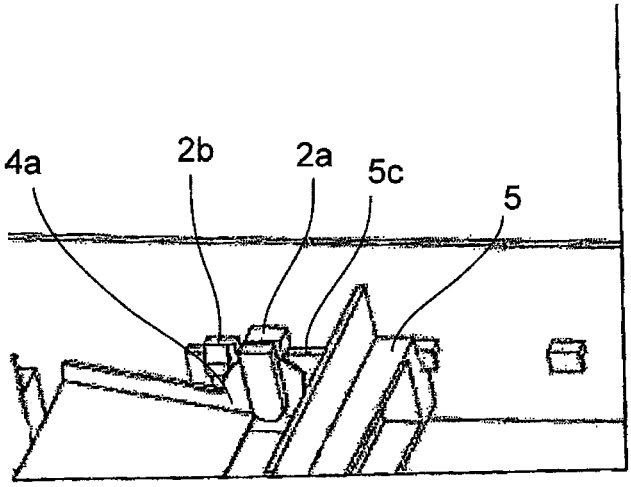
FIGS. 8A and 8B are detail views illustrating a movement of a rear end regulating member of the perspective view of FIG. 6A.
Figure 8B:
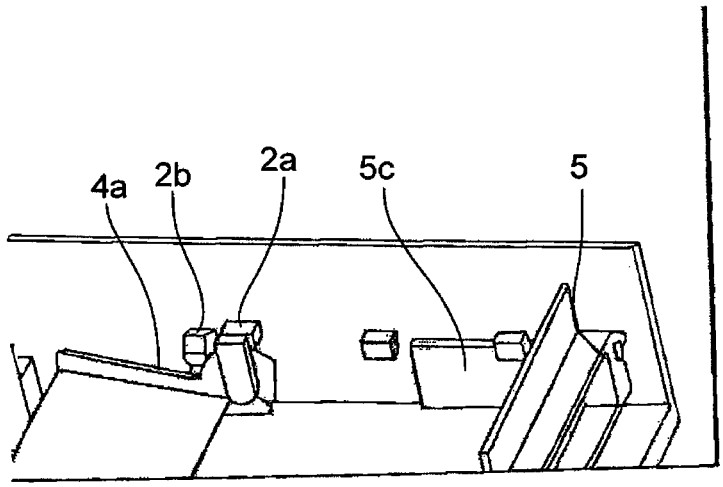

Further, in FIG. 7, the rear end regulating member 5 has at its both ends a holding portion 5*c* formed toward the intermediate plate 4. In the transportation, the holding portion 5*c* of the rear end regulating member 5, as illustrated in FIG. 8A, is inserted between the lower portion of the rotation fulcrum shaft 2*a* and the intermediate plate holding portion 2*b* and the cassette body 2.

The holding portion 5*c* is inserted between the lower portion of the rotation fulcrum shaft 2*a* and the intermediate plate holding portion 2*b* and the cassette body 2, whereby the rotation fulcrum shaft 2*a* and the intermediate plate holding portion 2*b* can be prevented from being elastically deformed. According to this constitution, the relative movement between the rotation fulcrum shaft 2*a* of the cassette body 2 and the rotation fulcrum portion 4*a* of the intermediate plate 4 can be regulated, whereby the breakage of the intermediate plate 4 and the detachment of the intermediate plate 4 from the rotation fulcrum shaft 2*a* of the cassette body 2 due to vibrations and impacts in the transportation can be prevented.

As described above, in the present embodiment, in the transportation, the holding portion 5*c* is inserted between the lower portion of the rotation fulcrum shaft 2*a* and the intermediate plate holding portion 2*b* and the cassette body 2, and, at the same time, the rear end regulating member 5 is set to a position not in contact with the intermediate plate 4, as illustrated in FIG. 7.

According to the above constitution, if vibrations and impacts occur in the transportation, the rear end regulating member 5 prevents the rotation fulcrum shaft 2*a* and the intermediate plate holding portion 2*b* from being elastically deformed, whereby the breakage of the intermediate plate 4 and the detachment of the intermediate plate 4 from the rotation fulcrum shaft 2*a* can be prevented. Further, when the rear end regulating member 5 is set to the above transportation position, the rear end regulating member 5 is not in contact with the intermediate plate 4, and therefore, it is unnecessary to perform the operation for sliding the rear end regulating member 5 to a position allowing the intermediate plate 4 to freely rotate, depending on the sheet size. According to this constitution, the usability is enhanced, and the feeding failure due to erroneous operation does not occur.

While the present invention has been described with reference to exemplary embodiments, it is to be understood that the invention in not limited to the disclosed exemplar embodiments. The scope of the following claims is to be accorded the broadest interpretation so as to encompass all such modifications and equivalent structures and functions.

This application claims the benefit of Japanese Patent Application No. 2008-140490, filed May 29, 2008, which is hereby incorporated by reference herein in its entirety.

What is claimed is:

1. A sheet feeder which feeds a sheet stored in a sheet cassette, by a sheet feed member, wherein the sheet cassette comprises:

a cassette body which stores sheets therein;

a sheet stacking plate which is rotatably supported by a rotation support portion and rotates to press the sheets stacked on the sheet stacking plate against the sheet feed member, wherein the rotation support portion includes a support portion provided in the cassette body and an engagement portion, which is provided in the sheet stacking plate and can engage with the support portion;

a regulating member which is movably provided in the cassette body and regulates a position of the sheets stacked on the sheet stacking plate; and a detachment preventing portion which is provided in the regulating member and covers the engagement portion of the sheet stacking plate from above so as not to move in up and down directions when the regulating member is moved to a predetermined position, thereby preventing the engagement portion being detached from the support portion in the cassette body in a state that the sheet stacking plate can rotate.

2. The sheet feeder according to claim 1, wherein the detachment preventing portion regulates the movement of the support portion of the cassette body in a direction detaching from the engagement portion of the sheet stacking plate.

3. The sheet feeder according to claim 1, wherein the detachment preventing portion regulates a relative movement between the support portion of the cassette body and the engagement portion of the sheet stacking plate.

4. The sheet feeder according to claim 1, wherein the predetermined position where the detachment preventing portion prevents the detachment of the engagement portion corresponds to a position where the regulating member regulates the position of the sheet having a predetermined size.

5. The sheet feeder according to claim 1, wherein the regulating member is a rear end regulating member, which is provided in the cassette body so as to freely move in a sheet feeding direction and regulates a rear end position of the sheets stacked on the sheet stacking plate.

6. The sheet feeder according to claim 1, wherein the regulating member is a side end regulating member, which is provided in the cassette body so as to freely move in a direction perpendicular to a sheet feeding direction and regulates a side end of the sheets stacked on the sheet stacking plate.

7. An image forming apparatus comprising a sheet feeder which feeds a sheet, stored in a sheet cassette, by a sheet feed member, and an image forming portion which forms an image on a sheet fed from the sheet feeder, wherein the sheet cassette comprises:

a cassette body which stores sheets therein;

a sheet stacking plate which is rotatably supported by a rotation support portion and rotates to press the sheets stacked on the sheet stacking plate against the sheet feed member, wherein the rotation support portion includes a support portion provided in the cassette body and an engagement portion, which is provided in the sheet stacking plate and can engage with the support portion;

a regulating member which is movably provided in the cassette body and regulates a position of the sheets stacked on the sheet stacking plate; and a detachment preventing portion which is provided in the regulating member and covers the engagement portion of the sheet stacking plate from above so as not to move in up and down directions when the regulating member is moved to a predetermined position, thereby preventing the engagement portion from being detached from the support portion in the cassette body in a state that the sheet stacking plate can rotate.

8. The image forming apparatus according to claim 7, wherein the detachment preventing portion regulates the movement of the support portion of the cassette body in a direction detaching from the engagement portion of the sheet stacking plate.

9. The image forming apparatus according to claim 7, wherein the detachment preventing portion regulates a relative movement between the support portion of the cassette body and the engagement portion of the sheet stacking plate.

10. The image forming apparatus according to claim 7, wherein the predetermined position where the detachment preventing portion prevents the detachment of the engagement portion corresponds to a position where the regulating member regulates the position of the sheet having a predetermined size.

11. The image forming apparatus according to claim 7, wherein the regulating member is a rear end regulating member, which is provided in the cassette body so as to freely move in a sheet feeding direction and regulates a rear end position of the sheets stacked on the sheet stacking plate.

12. The image forming apparatus according to claim 7, wherein the regulating member is a side end regulating member, which is provided in the cassette body so as to freely move in a direction perpendicular to a sheet feeding direction and regulates a side end of the sheets stacked on the sheet stacking plate.

* * * * *